United States Patent [19]

Hanula et al.

[11] 4,350,256

[45] Sep. 21, 1982

[54] ROTARY COUPLER WITH A SPECIALLY CONFIGURED PINHOLE

[75] Inventors: Richard M. Hanula, Lyndhurst; Fred C. Kulieke, Jr., Tallmadge, both of Ohio

[73] Assignee: Midland-Ross Corporation, Cleveland, Ohio

[21] Appl. No.: 190,570

[22] Filed: Sep. 25, 1980

[51] Int. Cl.[3] ..... B61G 9/020

[52] U.S. Cl. ..... 213/69; 213/62 R

[58] Field of Search ..... 213/62 A, 62 R, 50, 213/50.5, 51, 60, 61, 64, 66, 67 R, 69, 70, 71, 72, 63, 65, 68; 403/409, 379, 378, 324; 105/3, 4

[56] References Cited

U.S. PATENT DOCUMENTS

| | | | |
|---|---|---|---|
| 1,684,209 | 9/1928 | Whitridge et al. | 213/69 |
| 3,635,358 | 1/1972 | Altherr | 213/69 |
| 4,192,089 | 3/1980 | Schwappach | 403/379 X |

*Primary Examiner*—Joseph F. Peters, Jr.
*Assistant Examiner*—M. J. Hill
*Attorney, Agent, or Firm*—Harlan E. Hummer

[57] ABSTRACT

A rotary F coupler is described as having an improved pinhole design, wherein the backwall of the pinhole has a generally cylindrical, rectangularly shaped pin bearing surface which projects into the pinhole about three-quarters of an inch, compared to the conventional projection or crown of one-quarter of an inch, and in such a way as to prevent unduly high stress concentrations in the coupler shank caused by contact of the shank and pivot pin during vertical angling of the coupler.

10 Claims, 5 Drawing Figures

ROTARY COUPLER WITH A SPECIALLY CONFIGURED PINHOLE

BACKGROUND OF THE INVENTION

The invention relates to F-type railroad car couplers, especially the rotary-type in which a pinhole is formed in the butt end of the shank of the coupler. Existing F couplers have a pinhole with a backwall, i.e. the wall closest the butt end of the shank, which comprises a small elliptical or hexagonal-shaped cylindrical pin bearing surface from which curved top and bottom portions of the backwall extend and diverge in the direction of the butt end of the shank, so that the pin bearing surface projects into the pinhole. The constant movement of the pivot pin against the backwall of the pinhole, when the coupler is in a normal horizontal pull position, wears away this projection or crown so that the backwall is vertically straight or cylindrical between opposing ends of the pinhole. It can be readily appreciated that, upon vertical angling of the coupler, the pivot pin will then alternately bear against portions of the backwall adjacent opposing ends of the pinhole to produce at these points, large concentrations of stress which can cause fatigue and eventual fracturing of the shank in the area of the pinhole. The invention is directed to a pinhole with a highly improved pin bearing surface.

Briefly stated, the invention is in a railroad car coupler having a pinhole with a specially configured backwall that has a crown or projection which is at least twice that of the aforementioned existing rotary F couplers. The backwall is provided with a cylindrical pin bearing surface which has a generally rectangular shape that has a pair of spaced, longitudinally extending curved marginal edges from which a pair of reversely curved surfaces extend rearwardly toward the butt end of the coupler shank. The convex-concave curvature of these curved surfaces are such that, upon one-quarter inch wear of the backwall, the height of the pin bearing surface in relation to overall height of the backwall will not be radically changed to a point where, upon vertical angling of the coupler, the pivot pin will contact the shank in such a way to produce the aforementioned, undesireable high stress concentrations.

DESCRIPTION OF THE DRAWING

The following description of the invention will be better understood by having reference to the accompanying drawing, wherein.

ENVIRONMENT OF THE INVENTION

Figure 1:
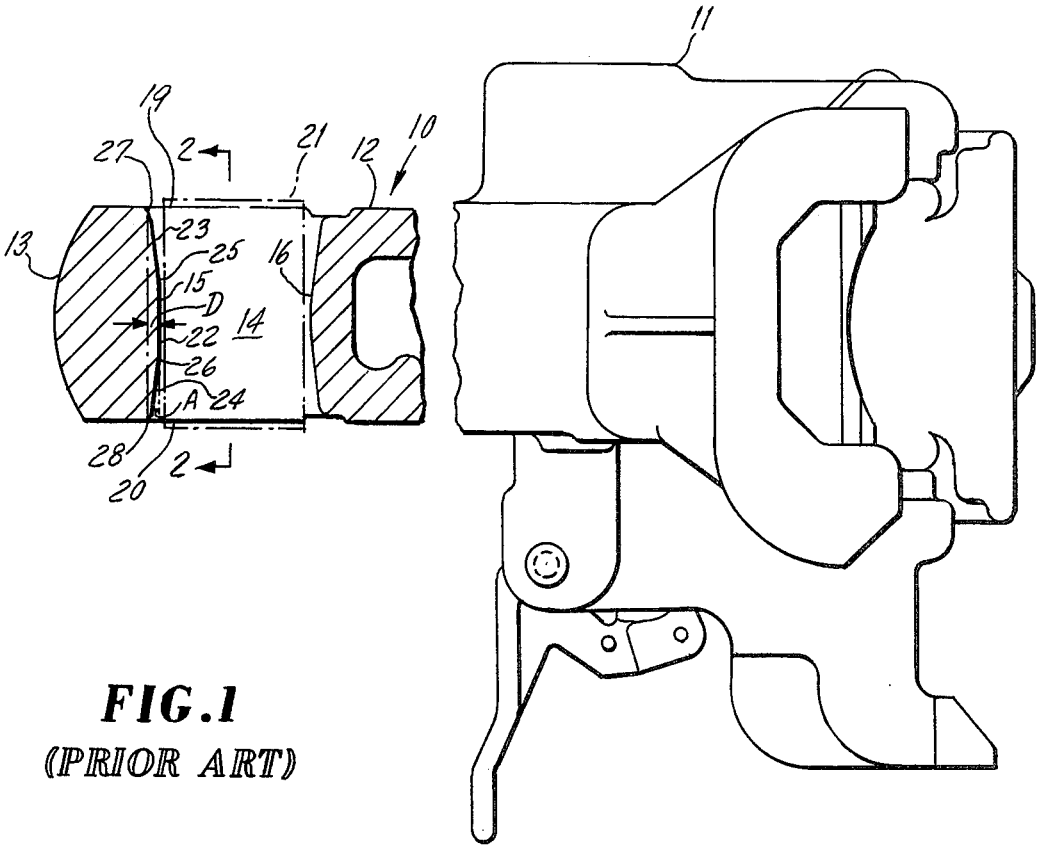
FIG. 1 (PRIOR ART)
FIG. 1 is a side view of a conventional prior art coupler with the butt end of the coupler shank shown in cross-section.
Figure 2:
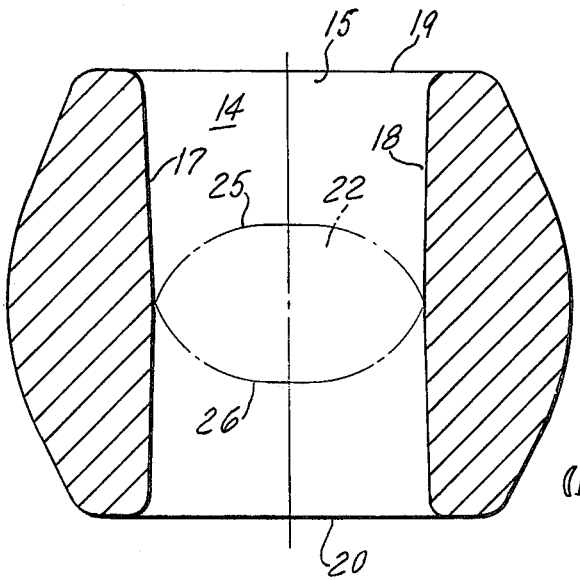
FIG. 2 (PRIOR ART)
FIG. 2 is an enlarged section of the coupler viewed from the line 2—2 of FIG. 1.

With general reference to the drawing for like parts, and more particular reference to FIGS. 1 and 2, there is shown an F-type rotary coupler 10 which comprises the essential components of a head 1 and a shank 12 which extends from the coupler head 11 and terminates at a butt end 13. A pinhole 14 extends transversely through the coupler shank 12 adjacent the butt end 13. The pinhole 14 is formed by a forward facing backwall 15 and a rearward facing frontwall 16, relative to the coupler head 11, and a pair of oppositely disposed interconnecting sidewalls 17,18, all of which walls extend between top and bottom sides 19,20 of the coupler shank 12, when the coupler 10 is in a normal, horizontal operating position, as shown in the drawing. A pivot pin 21 shown, in part in dotted line, is used to mount the coupler shank 12 to a rotary connector or any other suitable mechanism which allows angling and rotation of the coupler 10.

The backwall 15 is closer the butt end 13 of the coupler shank 12 than the frontwall 16 and comprises a cylindrically curved pin bearing surface 22 which is generally elliptically shaped, as best seen in FIG. 2. A pair of sloping surfaces 23,24 extend from opposing curved marginal edges 25,26 of the elliptical pin bearing surface 22 rearwardly in the direction of the butt end 13 of the coupler shank 12. The sloping surfaces 23,24 extend from the elliptical pin bearing surface 22 at an angle A of about 7° so that the pin bearing surface 22 projects into the pinhole a distance D of about one-quarter of an inch.

It can be appreciated that the backwall 15 will become cylindrical between the top and bottom sides 19,20 of the coupler shank 12, as the crown or projection of the pin bearing surface 22 is worn away. From the standpoint of fatigue, the coupler should be replaced when this happens, since the pivot pin 21, upon vertical angling of the coupler, alternately contacts backwall portions 27,28 adjacent opposing ends of the pinhole 14 to produce severe concentrations of stress which can cause fatigue and fracturing of the coupler shank in the area of the pinhole 14. This problem exists to a lesser degree in non-rotary type couplers which have heavier shanks that more ably withstand such high stresses. The shanks of rotary couplers must be reduced to compensate for the rotary mechanisms to which they're attached, thereby making them more susceptible to fatigue and fracturing. It should be mentioned that the so-called condemning limit, or mandatory point of replacement of the coupler, occurs when the backwall of the shank between the pinhole and butt end of the shank is worn one-half inch. However, most of the wear occurs adjacent the pinhole, and it is not uncommon for the crown or projection of the pin bearing surface to be worn away before the coupler reaches the condemning limit.

The frontwall 16 and sidewalls 17,18 of the pinhole 14 converge towards the center axis of the coupler shank to permit limited roll and angling of the coupler.

THE INVENTION

Figure 3:
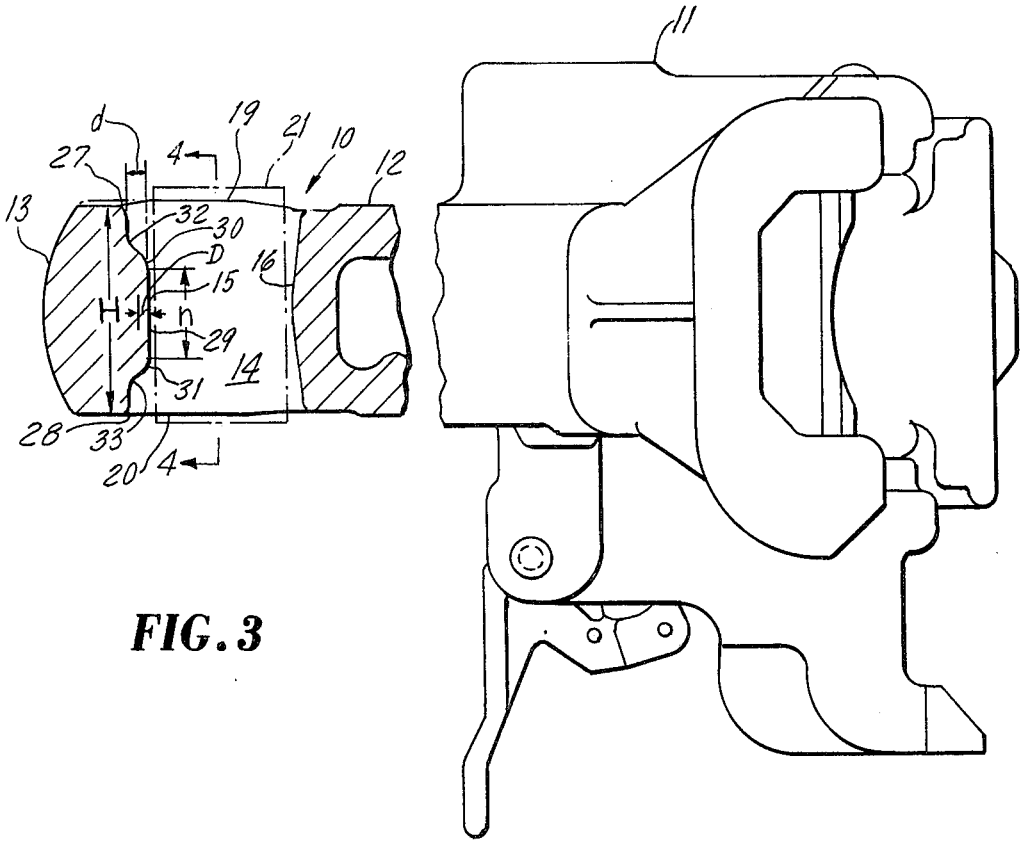
FIG. 3 is a side view of a coupler made in accordance with the invention with the butt end of the shank of the coupler shank shown in cross-section for comparison with that of the conventional coupler of FIG. 1.
Figure 4:
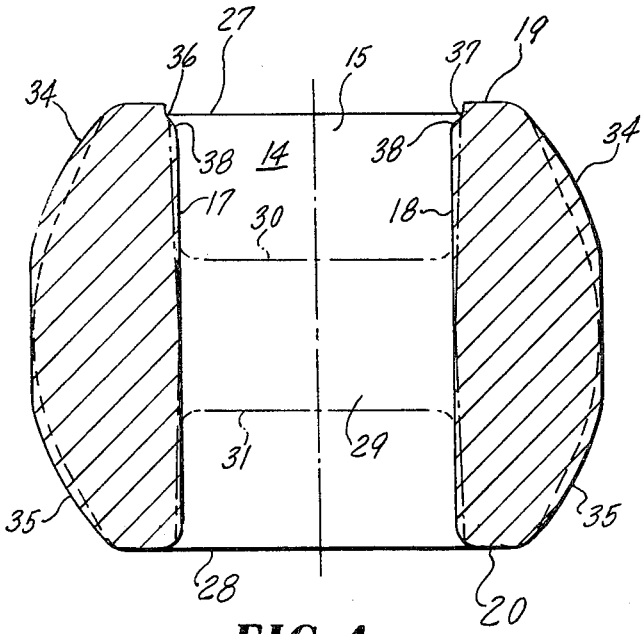
FIG. 4 is an enlarged section of the coupler of the invention viewed from the line 4—4 of FIG. 3.
Figure 5:
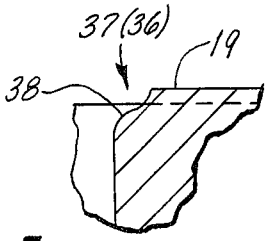
FIG. 5 is an enlarged section of the top portion of the coupler shank adjacent the pinhole.

With particular reference to FIGS. 3 and 4, the backwall 15 of the invention is provided with a cylindrically curved, pin bearing surface 29 which is generally rectangularly shaped, as best seen in FIG. 4. The rectangular pin bearing surface 29 has a pair of opposing curved marginal edges 30,31 which are in substantially parallel planes. A pair of reversely curved surfaces 32,33 extend in opposite directions from the marginal edges 30,31 of the rectangular pin bearing surface 29, rearwardly in the direction of the butt end 13 of the coupler shank 12, so that the rectangular pin bearing surface 29 projects into the pinhole 14 a distance d of about three-quarters of an inch compared to the approximate one-quarter inch projection of the elliptical pin bearing surface 22. Thus, the rectangular pin bearing surface 29 can wear an additional one-half inch before it is an equivalent cylindrical shape between opposing ends 27,28 of the pinhole 14. The height h, e.g. 2 inches, of the rectangular pin bearing surface 29 will not exceed, for example, 60% of the overall height H, e.g. $5\frac{5}{8}$ inches, of the backwall 15, when the pin bearing surface 29 is worn one-quarter of an inch. There will still remain a crown or projection of at least one-quarter of an inch if all the wear of the backwall 15, to condemning limits of the coupler, as previously described, is in the new, improved projecting rectangular pin bearing surface 29.

The sidewalls 17,18 of the pinhole 14 are preferably parallel and straight or flat between opposing ends thereof and do not converge towards the center of the coupler shank as do the sidewalls of the conventional rotary coupler, (note dotted line for comparison), the effect of which is to produce thicker sidewalls 17,18 adjacent the top and bottom sides 19,20 of the coupler shank 12. It is believed that the clearances between various parts of the assembly of coupler, rotary connector, pin and yoke, will be sufficient to provide adequate roll capabilities between adjacent railroad cars. The sidewalls 17,18 are each further thickened by adding about $\frac{1}{8}$ inch of material primarily at the outer surfaces 34,35 thereof adjacent the top and bottom sides 18,20, (see dotted lines). The cross-sectional area of each sidewall is increased by about 11%. The heavier sidewalls 17,18 are naturally less susceptible to fatigue and fracturing, since they can withstand greater stress.

The sidewalls 17,18 are provided with specially configured top marginal edges 36,37, each of which includes a vertically recessed rounded corner 38 adjacent the pinhole 15, so that initial wear of the adjacent top side 19 of the coupler shank 12 will not adversely affect the rounded corner 38 by sharpening it, as is the case when the rounded corner 38 is not recessed vertically below the top side 19 of the coupler shank 12. To those skilled in the art, it can be appreciated that this particular configuration of the top marginal edges 36,37 of the sidewalls 17,18 provides more than normal amounts of material that must be worn away before the rounded corners 38 are exposed and worn to a point where the top marginal edges 36,37 become pointed or sharp and subject to extreme stress buildup which can cause fatigue and fracturing of the sidewalls 17,18 of the coupler shank 12. The overall height of the sidewalls 17,18 in the area of the pinhole 14 has been maintained, but the overall height H of the backwall 15 of the coupler of the invention has been reduced by about one-eighth of an inch, to maintain proper vertically angling of the coupler. However, this reduction in the height of the backwall 15 has proven to be inconsequential in view of the improved design and beefing up of the backwall in other areas of the shank, as described.

Thus, there has been provided a rotary coupler with a highly improved pinhole which extends the wear of the coupler and helps to eliminate high stress areas which can cause fracturing and failure of the coupler shank.

What is claimed is:

1. A railroad car coupler, comprising:

(a) a coupler head;

(b) a shank extending from the coupler head and terminating at a butt end thereof, the shank having a pinhole extending transversely therethrough adjacent the butt end, the pinhole having a pair of opposing ends between which are a backwall in closer spaced relation to the butt end than a frontwall which is spaced from the backwall closer the coupler head, and a pair of sidewalls connecting the backwall and frontwall, the backwall terminating at opposing ends at the opposing ends of the pinhole and including:

(I) a pin bearing surface disposed generally centrally of the backwall for contacting a cylindrical pin that is used to hold the coupler in position on a railroad car, the pin bearing surface being cylindrically curved to matingly engage the cylindrical pin when the coupler is in pull and having a generally rectangular shape defined between a pair of opposing marginal edges which are curved and contained in parallel planes which are generally parallel to planes containing the opposing ends of the backwall; and (II) a pair of curved surfaces extending in opposite directions from the pair of marginal edges of the pin bearing surface rearwardly towards the butt end of the shank, the curved surfaces terminating at opposing ends of the backwall rearwardly of the pin bearing surface closer the butt end and being shaped so that the pin bearing surface projects into the pinhole beyond the opposing ends of the backwall a distance (d) such that when a correspondingly measured distance (D) of one-quarter of an inch of the pin bearing surface is worn away, the worn pin bearing surface will still project into the pinhole beyond the opposing ends of the backwall.

2. The railroad car coupler of claim 1, wherein the height (h) of the pin bearing surface will not be more than 60% of the correspondingly measured height (H) of the backwall, when the surface is worn said one-quarter of an inch.

3. The railroad car coupler of claim 1, wherein the pin bearing surface projects into the pinhole a distance (d) of about $\frac{3}{4}$ inches.

4. The railroad car coupler of claim 1, wherein the frontwall and backwall of the pinhole are connected by a pair of opposing sidewalls which are generally straight between opposing ends thereof.

5. The railroad car coupler of claim 4, wherein the vertically uppermost top of each sidewall adjacent the pinhole, when the coupler is in a normal horizontal operating position, is provided with a continuous rounded corner which is recessed downwardly from the top of each sidewall.

6. The railroad car coupler of claim 1, which is a rotary F coupler and wherein the pin bearing surface will provide a projection in the pinhole even after the backwall, between the pinhole and butt end of the coupler shank, is worn one-half inch to the condemning limit of the coupler.

7. A rotary F-type railroad car coupler, comprising:

(a) a coupler head;

(b) a shank extending from the coupler head and terminating at a butt end thereof, the shank having a pinhole extending transversely therethrough adjacent the butt end, the pinhole having a pair of opposing ends between which are a backwall in closer spaced relation to the butt end than a frontwall which is spaced from the backwall closer the coupler head, and a pair of sidewalls connecting the backwall and frontwall, the backwall terminating at opposing ends at the opposing ends of the pinhole and including:

(I) a pin bearing surface disposed generally centrally of the backwall for contacting a cylindrical pin that is used to hold the coupler in position on a railroad car, the pin bearing surface being cylindrically curved to matingly engage the cylindrical pin when the coupler is in pull and having a generally rectangular shape defined between a pair of opposing marginal edges which are curved and contained in parallel planes which are generally parallel to planes containing the opposing ends of the backwall; and (II) a pair of reversely curved surfaces extending in opposite directions from the pair of marginal edges of the pin bearing surface rearwardly towards the butt end of the shank, the curved surfaces terminating at opposing ends of the backwall rearwardly of the pin bearing surface closer the butt end and being shaped so that the pin bearing surface projects into the pinhole beyond the opposing ends of the backwall a distance (d) which is greater than $\frac{1}{4}$ inches; and (c) the sidewalls each including:

(I) a marginal edge having continuously recessed therein adjacent the pinhole, a rounded corner that faces the pinhole.

8. The rotary F-type railroad car coupler of claim 7, wherein each sidewall is generally flat between opposing ends thereof.

9. The rotary F-type railroad car coupler of claim 8, wherein the pin bearing surface projects into the pinhole a distance of about $\frac{3}{4}$ inches.

10. The rotary F-type railroad car coupler of claims 1, 7 or 9, wherein the curved surfaces extending from the marginal edges of the pin bearing surface are first generally convex and then generally concave in relation to the center axis of the coupler shank.

* * * * *